US006584642B2

(12) United States Patent
Hodson

(10) Patent No.: US 6,584,642 B2
(45) Date of Patent: Jul. 1, 2003

(54) MULTI-FUNCTION DOOR STOP AND DOOR RESTRAINT

(76) Inventor: Ernest F. Hodson, 154 Governor Trumbull Way, Trumbull, CT (US) 06611

( * ) Notice: Subject to any disclaimer, the term of this patent is extended or adjusted under 35 U.S.C. 154(b) by 0 days.

(21) Appl. No.: 10/264,469

(22) Filed: Oct. 4, 2002

(65) Prior Publication Data

US 2003/0066163 A1 Apr. 10, 2003

Related U.S. Application Data

(63) Continuation-in-part of application No. 10/005,792, filed on Nov. 2, 2001.

(60) Provisional application No. 60/327,501, filed on Oct. 5, 2001.

(51) Int. Cl.[7] ..... E05F 5/06

(52) U.S. Cl. ..... 16/85; 16/86 B; 16/86 C; 292/338

(58) Field of Search ..... 16/82, 85, 86 R, 16/86 A, 86 B, 86 C; 292/DIG. 15, DIG. 17, DIG. 19, 338, 330, 342, 339

(56) References Cited

U.S. PATENT DOCUMENTS

| | | | | | |
|---|---|---|---|---|---|
| 318,323 | A | * | 5/1885 | Teetzel | 292/230 |
| 539,741 | A | * | 5/1895 | Ingram | 16/277 |
| 847,345 | A | * | 3/1907 | Leach | 292/230 |
| 984,118 | A | * | 2/1911 | Wilcox | 16/85 |
| 1,704,967 | A | * | 3/1929 | Fuller | 292/338 |
| 1,948,640 | A | * | 2/1934 | Andrews | 16/86 B |
| 2,449,686 | A | * | 9/1948 | Brinda | 16/85 |
| 3,006,676 | A | * | 10/1961 | Germock, Jr. | 292/338 |
| 3,809,419 | A | * | 5/1974 | Chezem | 292/338 |
| 3,831,989 | A | * | 8/1974 | Gurzenda | 292/338 |
| 4,244,081 | A | * | 1/1981 | Beyer et al. | 16/228 |
| 5,060,344 | A | * | 10/1991 | Cress | 16/332 |
| 5,226,201 | A | * | 7/1993 | Lefebvre | 16/86 A |
| 5,282,658 | A | * | 2/1994 | Reeves, Jr. | 292/338 |
| 5,515,575 | A | * | 5/1996 | Pinazza | 16/228 |
| 5,761,766 | A | * | 6/1998 | Basham | 16/85 |
| 5,815,899 | A | * | 10/1998 | Chao | 29/20 |
| 6,151,754 | A | * | 11/2000 | Chen | 16/85 |

FOREIGN PATENT DOCUMENTS

FR 2790030 A1 * 8/2000

* cited by examiner

*Primary Examiner*—Chuck Y. Mah
(74) *Attorney, Agent, or Firm*—John R. Doherty

(57) ABSTRACT

A multi-function door stop is provided comprising a first vertical plate for mounting to a wall and a second horizontal plate affixed to and extending outwardly from the first plate. A hollow elongated tube extends outwardly in a direction away from the second plate in a normal position substantially perpendicular to the first plate. An extension member is interposed between the second plate and the elongated tube, the extension member being fixedly secured at one end to the second plate. The elongated tube is pivotally connected to the other end of the extension member permitting adjustment of the tube to a ninety degree impact with the door. A means is associated with the extension member for releasably locking the tube in its normal position. In use, the door stop remains in its normal position until the elongated tube is struck by an object, such as a vacuum cleaner or mop. The impact releases the tube from its locked position and allows it to swing about its pivot point to an out of the way position substantially parallel to the wall.

11 Claims, 6 Drawing Sheets

MULTI-FUNCTION DOOR STOP AND DOOR RESTRAINT

PRIORITIES

The present application is a continuation-in-part of my earlier application Ser. No. 10/005,792 entitled "DOOR STOP", filed on Nov. 2, 2001. This application also claims priority to my earlier provisional application Ser. No. 60/327,501, entitled "DOOR STOP AND DOOR RESTRAINT RECEPTACLES, filed on Oct. 5, 2001.

FIELD OF THE INVENTION

The present invention relates to door stops and door restraints in general and more particularly to multi-functional door stops with variable adjustments for aligning the door stop with a door and door restraint devices for use in combination with door stops and particularly those of the above type.

DESCRIPTION OF THE PRIOR ART

Wall-mounted door stops of the known type protrude outwardly from the wall and can be a nuisance to those performing normal maintenance or household cores, such as vacuuming, sweeping or mopping the floor. These door stops are often struck by vacuum cleaners, brooms, mops and the like and can be broken, damaged or loosened from the wall. They can also cause damage to the cleaning devices and injury to persons as well.

Door stops employing a helical coil are also know in the art. These door stops are able to move or bend laterally when struck by an object, such as a vacuum cleaner, and then return to their normal position once the force of the impact has been removed. The problem with this type of door stop is that the coil springs back quickly to its normal position, only to be struck again by the cleaning device. This repeated activity can be annoying to maintenance personnel who are usually forced to maneuver carefully around the door stop in order to avoid striking it again.

It is therefore an object of the invention to provide an improved door stop of the type which is mounted to a wall.

Another object of the invention is to provide a wall-mounted door stop which is designed to swing out of the way when struck by an object, such as a vacuum cleaner or mop, and then automatically or manually returned to its normal position without damaging itself or the object.

Still another object of the invention is to provide a wall-mounted door stop which can be moved temporally by maintenance personnel to a non-operative position essentially parallel to the wall and held in this position until the maintenance operation has been completed.

SUMMARY OF THE INVENTION

The present invention provides a door stop comprising a first vertical member for mounting to the wall. A second horizontal member is affixed to and extends outwardly from the first member and acts as a pivot plate. A third elongated member is pivotally mounted at its inner end to the second member and extends outwardly at its outer end to a normal position substantially perpendicular to the wall for making contact with a swinging door. A means is associated with the second member for releaseably locking the third member in its normal position.

In use, the door stop remains in its normal position until the third elongated member is struck by an object, such as a vacuum cleaner or mop, for example. The impact releases the third member from its locked position and allows it to swing about its pivot point on the second member to an out-of-the-way position, such as one that is substantially parallel to the wall.

In a preferred embodiment of the invention, the second member or pivot plate is formed along its outer edge with an arcuately shaped cam surface. A cam follower is provided at the inner end of the third elongated member and is biased into contact with the cam surface by a spring. When the door stop is struck by an object, the third elongated member is caused to rotate or swing in a direction towards the wall with the cam follower traveling along the cam surface. The cam surface is designed such that as the third elongated member approaches the wall, the follower is forced inwardly by the cam surface, compressing the spring which in turn forces the elongated member to return to its normal position.

In another preferred embodiment of the invention, the second horizontal member or pivot plate is formed with a notch on its outer periphery at a location such that when the third elongated member is pivoted in a direction toward the wall, the cam follower will engage the notch and hold the third member in a locked position, such as one that is close to and substantially parallel to the wall. This operation can be performed manually or it can occur unintentionally when the door stop is struck by an object.

DESCRIPTION OF THE PREFERRED EMBODIMENTS

Figure 1:
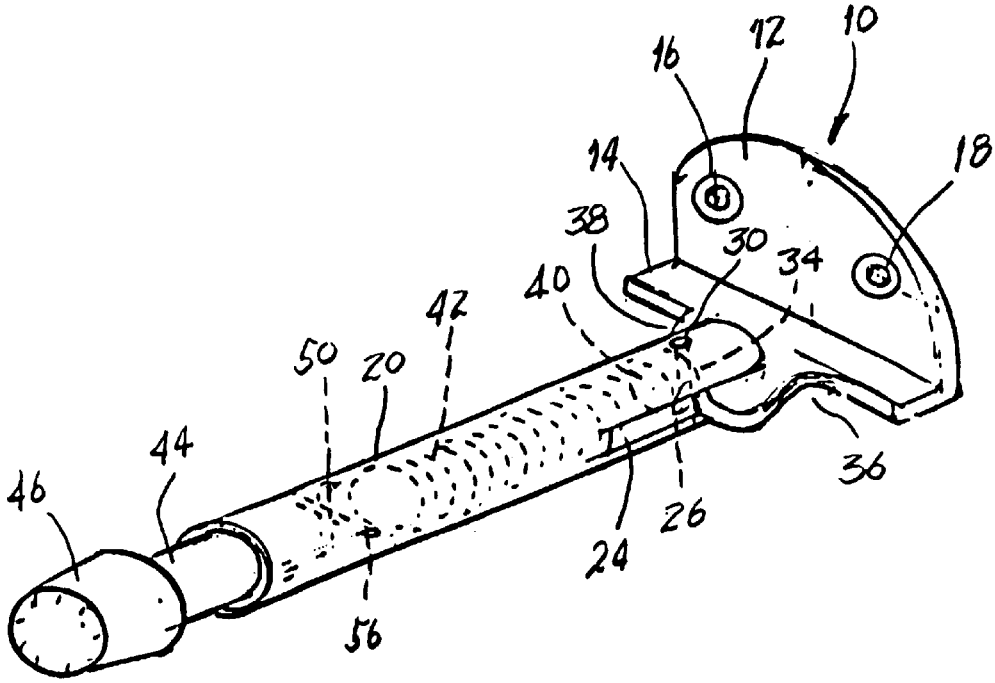
FIG. 1 is a perspective view of a door stop according to a preferred embodiment of the invention.

Referring now to the accompanying drawings, wherein like reference numerals refer to the same or similar parts, and particularly to FIGS. 1–7, inclusive, there is shown a door stop in accordance with a preferred embodiment of the invention. As shown, the door stop comprises a generally "L" shaped bracket 10, one leg of which constitutes a first vertical member or wall-mounting plate 12 and the other leg of which constitutes a second horizontal member or pivot plate 14. The mounting plate 12 has a pair of holes 16, 18 for mounting the door stop to a wall or baseboard using a pair of screws (not shown). The bracket 10 need not of course be "L" shaped but can be of other shapes such as "T" shaped, for example.

Figures 2, 10, 13, 15:
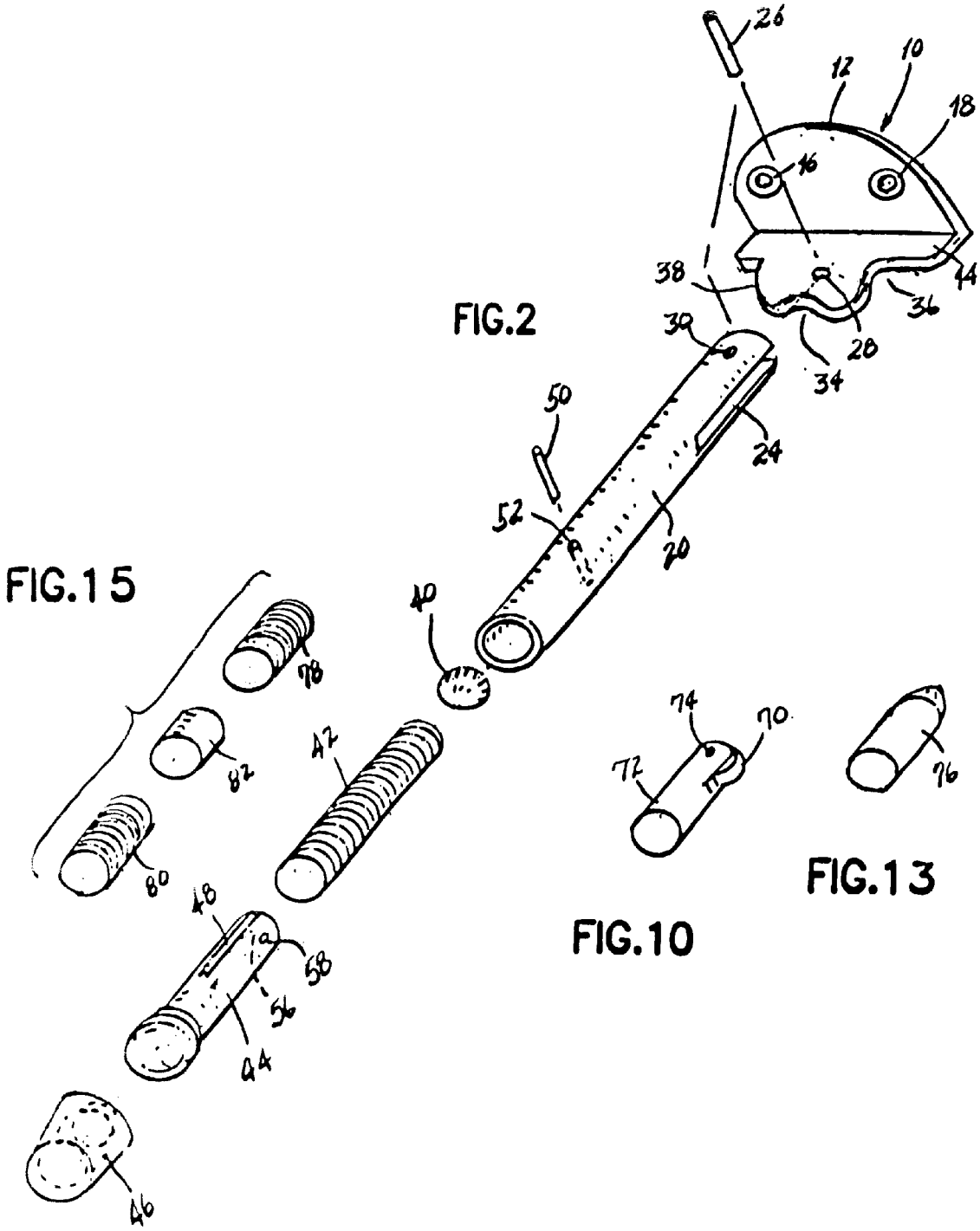
FIG. 2 is an exploded view of the door stop shown in FIG. 1.
FIG. 10 is a similar view showing a modified cam follower.
FIG. 13 is a perspective view of another modified cam follower.
FIG. 15 is an exploded view of a modified spring arrangement for use in the door stop shown in FIGS. 1–7, 11, 12 or 13.
Figure 3:
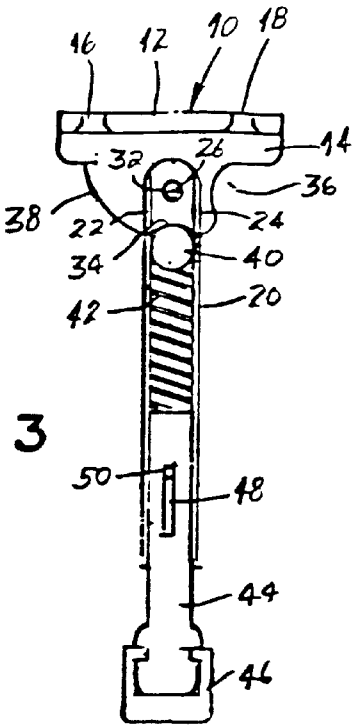
FIG. 3 is a top plan view of the door stop shown in FIGS. 1 and 2.
Figure 4:
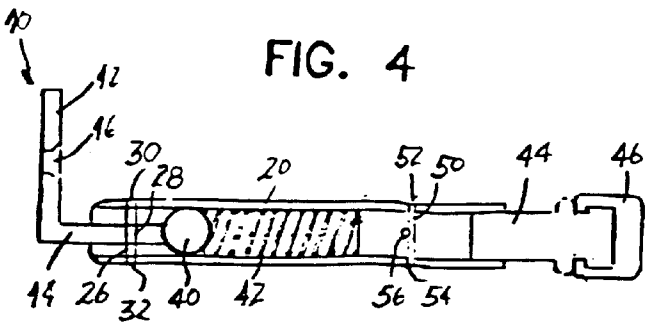
FIG. 4 is a side elevational view of the door stop.

A third elongated member or hollow tube 20 is provided and has a pair of elongated rectangular slots 22, 24 on opposite sides forming a yoke at its inner end for fitting the tube 20 around the periphery of the pivot plate 14. The pivot plate 14 is arcuately shaped at its periphery as shown in FIGS. 1, 2 and 3 to accommodate movement of the tube 20. The tube 20 is pivotally mounted to the plate 14 using a pivot pin 26 passing through a pivot hole 28 in the plate 14. The pivot pin 26 fits through a pair of aligned holes 30, 32 within the inner end of the tube 20. It will be seen by this arrangement that the tube 20 is free to rotate 180 degrees about the pivot pin 26 from one to the other side of the pivot plate 14.

A pair of notches are formed within the periphery of the plate 14 as shown at 34, 36. The first notch 34 is located along the central axis of the plate in alignment with the pivot hole 28. The second notch 36 is located approximately 90 degrees to one side of the first or center notch 34, in this embodiment, to the right side facing the bracket 10.

A cam surface 38 is also formed along the outer periphery of the pivot plate 14 on the opposite or left side of the first notch 34. The cam surface 38 is in the shape of an arc formed about the pivot hole 28 in such manner that the radial or radial distance of the arc from the pivot hole 28 increases with increasing distance from the center notch 34 as best shown in FIG. 3.

A cam follower in the form of a roller ball 40 is mounted inside the inner end of the tube 20 along with a coil spring 42. The spring 42 biases the roller ball 40 into contact with the first or center notch 34, locking the tube 20 into its normal position perpendicular to the mounting plate 12.

A cylindrical member or cushion rod 44 is telescopically fitted inside the outer end of the tube 20. This rod has attached to its outer end a resilient bumper 46 for making contact with a door as it swings toward the wall.

The cushion rod 44 has an elongated slot 48 in its innermost end as best shown in FIG. 2. A guide pin 50 extends vertically through the tube 20 and passes through the slot 48 in the rod 44. The pin 50 is mounted through holes in the tube 20 as shown at 52, 54. A second or retainer pin 56 extends through a hole or bore 58 provided in the innermost end of the rod 44. The retainer pin 56 is located behind the guide pin 50 and limits outward movement of the cushion rod 44. This arrangement at the same time allows the rod to thrust inwardly against the spring 42 absorbing the shock created by the door striking the bumper 46.

Figure 6:
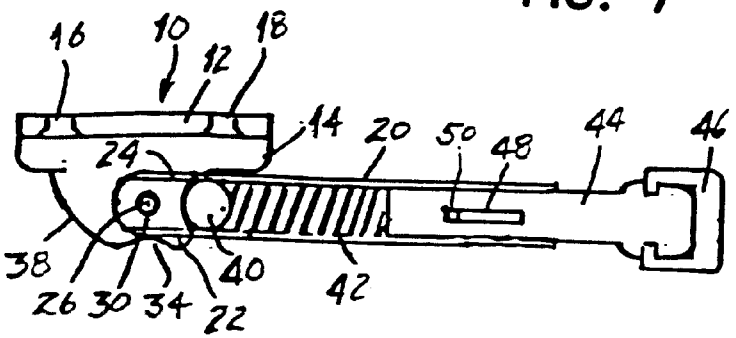
FIG. 6 is a view similar to FIG. 3 but showing the third elongated member rotated to the left side of the pivot plate.

Occasionally, during maintenance work, the door stop of the invention may be struck by an object other than a door, such as a vacuum cleaner or mop. Typically, the impact will occur at an angle to the tube 20 forcing the roller ball 40 out of engagement with center notch 34 and allowing the tube to swing about the pivot pin 26 in one of two directions, say to the left along the cam surface 38 as shown in FIG. 6. As the ball 40 travels along in contact with the cam surface 38, the ball will be gradually forced inwardly by the increasing radius or curvature of the arc about the pivot hole 28 as previously described. This action compresses the spring and forces the tube 20 to swing back to its normal position with the ball 40 again engaging the notch 34 once the impacting object has been withdrawn.

Figure 7:
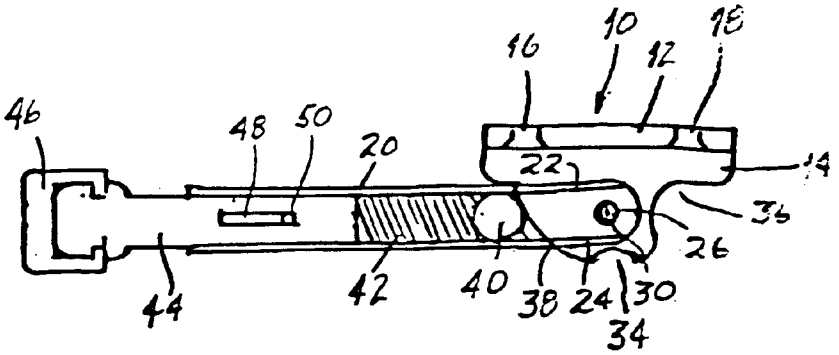
FIG. 7 is a similar view showing the third elongated member rotated to the opposite right side of the pivot plate.

If, on the other hand, the impact forces the tube 20 to swing to the right of the center notch 34, the tube will not encounter any bias exerted by the spring 44 and will come to rest in a position substantially parallel to the wall as shown in FIG. 7. The tube 20 will then be locked in this position by the engagement of the roller ball 40 with the second notch 36. This may, of course, only be temporary since the tube 20 can be easily released manually and returned again to its normal perpendicular position.

It may be expedient in certain cases to manually swing the tube 20 to the right toward the second notch 36 where it can be locked temporarily in its parallel to the wall position to keep it out of the way and free from contact with cleaning devices during maintenance operations.

Figure 8:
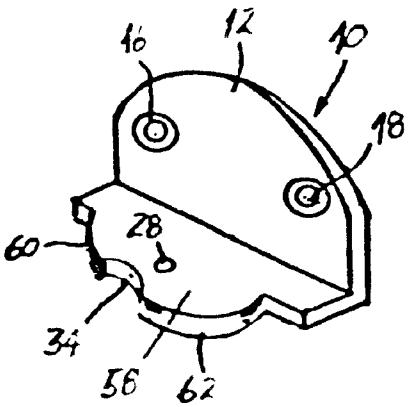

FIG. 8 shows a modified pivot plate 58 for use in the door stop of the invention. This pivot plate has two cam surfaces 60, 62, one on each side of the center notch 34. The cam surfaces are the same configuration as the cam surface 38 but, in this instance, the additional cam surface 62 is a mirror image of the cam surface 60. It will be seen that with this modification the tube 20 when impacted by an object can swing to either side of the central notch 34 and then be returned automatically to its normal position perpendicular to the bracket 10.

Figure 9:
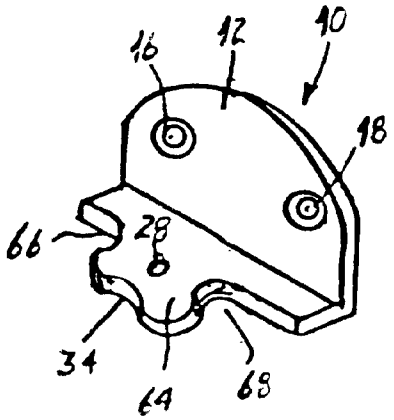
FIGS. 8 and 9 are perspective views of two modified pivot plates.

A similar modification is shown in FIG. 9 wherein the pivot plate 64 has two notches 66, 68 disposed substantially 180 degrees apart on its outer periphery. These notches are used in conjunction with the roller ball 40 to lock the tube 20 on either side of the bracket 10 in an out of the way position, parallel to the wall similar to that shown in FIG. 7.

Figure 11:
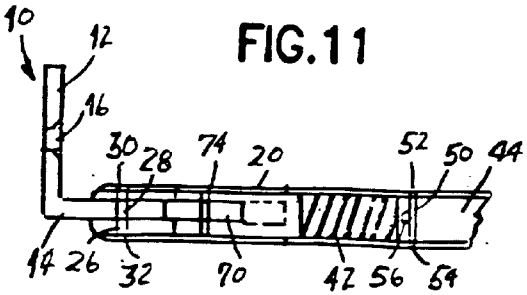
FIG. 11 is a side elevational, fragmentary view of a door stop employing the modified cam follower of FIG. 10.
Figure 12:
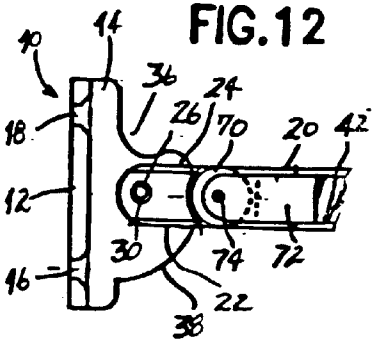
FIG. 12 is a top plan view thereof.

FIGS. 10–12, inclusive, show another modification in which the roller ball follower 40 is replaced by a wheel 70. The wheel 70 is mounted within the slotted end of a cylindrical member 72 by a pin 74. The coil spring 42 exerts pressure on the cylindrical member 72 which in turn keeps the wheel 70 in contact with the center notch 34 as more particularly shown in FIGS. 11 and 12.

Figure 14:
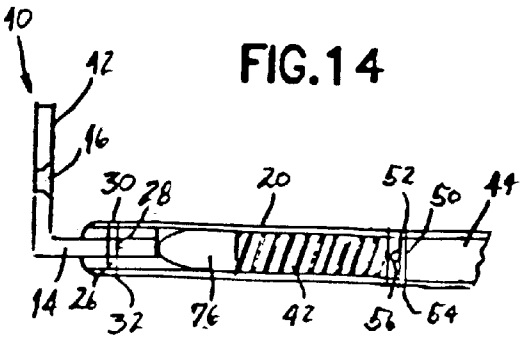
FIG. 14 is a side elevational, fragmentary view of a door stop employing the modified cam follower shown in FIG. 13.
Figure 5:
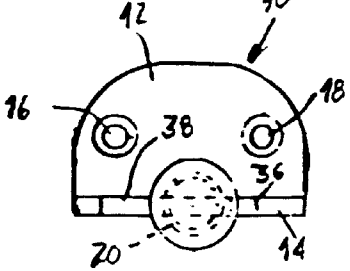
FIG. 5 is a front view thereof.

A pointed cylindrical member 76 may also be used as the cam follower as shown in FIGS. 13 and 14. The pointed end of the cylinder is again kept in contact with the notch 34 by the coil spring 42.

In all of the embodiments of the door stop so far described herein, a single spring member 42 is used to exert a bias pressure against both the cam follower 40 and the bumper rod 44 at opposite ends of tube 20. Although this arrangement is indeed expedient and useful in most instances, it is entirely possible to employ separate bias members or springs for each of these components as shown more particularly in FIG. 15. Here, two coil springs 78, 80 separated by a solid cylinder 82 are used to replace the single coil 42 inside the tube 20. The first spring 78 exerts a bias pressure against the cam follower or ball 40 at one end of the tube while the second spring 80 exerts a bias pressure against the cushion rod 44 at the opposite end of the tube. This arrangement has the advantage in that a heavier coil spring 80 may be utilized to absorb the shock when the swinging door impacts against the bumper 46 while at the same time employing a lighter coil spring 78 to exert bias pressure against the cam follower or roller ball 40. In such an arrangement, it would be necessary to fix the solid cylinder in place inside the tube 20, such as by means of a locating pin or the like.

Figures 16, 17, 18:
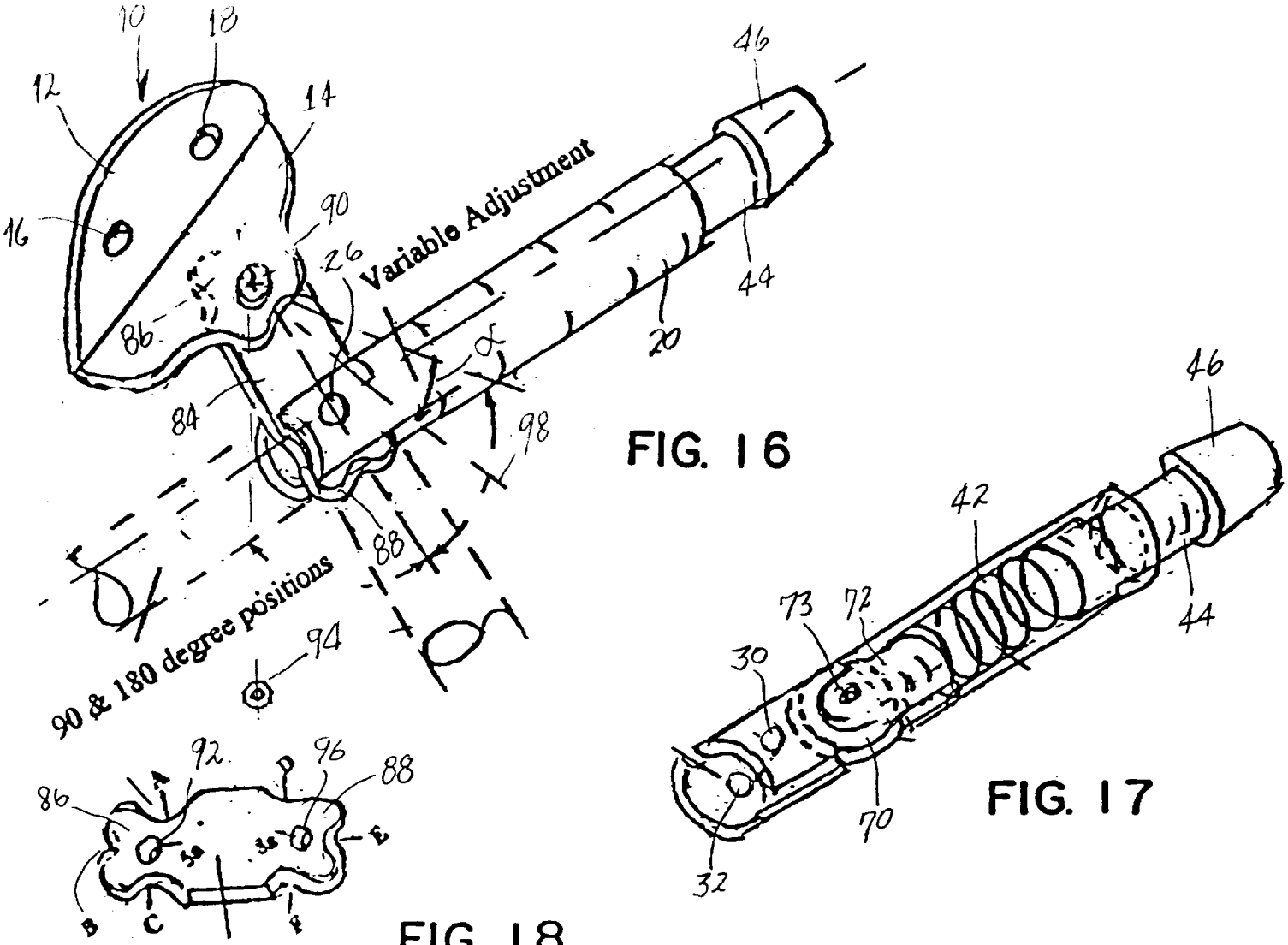
FIG. 16 is a perspective view of a modified multi-functional door stop according to the invention.
FIG. 17 is a similar view, partially cutaway, showing details of a third elongated member employed in the multi-functional door stop of FIG. 16.
FIG. 18 is a perspective view of an adjustable extension member also employed in the multi-functional door stop shown in FIG. 16.

Another modification of the invention which provides a multi-function door stop is shown in FIGS. 16–18. This modification includes an adjustable, intermediate extension member 84 which when attached between the bracket 10 and the hollow elongated tube 20 is able to perform a series of functions which otherwise might not possible with the previously described embodiments of the invention.

As best shown in FIG. 16, the extension member 84 is fixedly attached to the pivot plate 14 at its innermost end 86 while the elongated tube 20 is pivotally mounted to its opposite outer end 88. The extension member 84 may incorporate a number of notches and cam surfaces to position the tube 20 in any one of several different positions as described above or to return the tube 20 to its normal position for making contact with a door. For the sake of simplicity and while not limiting the invention, the extension member 84 is shown to have on its outer periphery (see FIG. 18) six position defining surfaces "A", "B" and "C" at its inner end 86 and "D","E" and "F" at its outer end 88. These may be notches or cam surfaces as described above or other possible configurations designed to allow certain specific functions to be performed by the door stop.

The extension member 84 may be attached to the pivot plate 14 by first removing the tapered pivot pin 26 passing through the pivot hole 28 in the plate 14 (see FIG. 2). A threaded bolt 90 is then inserted through both the pivot hole 28 and a mounting hole 92 provided within the inner end 86 of the extension member 84. A nut 94 is then threaded onto the bolt 90 to fix or lock the extension 84 to the pivot plate 14. At the other outer end 88 of the extension 84, the pivot pin 26, just removed from the tube 20, is then inserted back through the two aligned holes 30, 32 in the tube 20 and through a mounting hole 96 provided in the extension 84, thus allowing in this case the wheel 70, mounted to the cylinder 72 via the pin 73, to engage any one of the three positions or configurations "D", "E" or "F" provided on the periphery of the extension 84. This arrangement permits the door stop to be located with the tube 20 locked out of the way at position "D" to the right side of the mounting plate 12 or locked in its normal position "E" with the tube 20 extending outwardly in a direction away from the mounting plate 12. Alternatively, when pushed to the left side of the mounting plate 12 along the cam surface "F", the tube 20 will automatically return or swing back to its normal position at "E", for example.

The extension member 84 may be made in differing lengths, widths and thicknesses, and of various materials capable of being cast, machined or molded and to function with various types of spring loaded points, ball bearings or wheels designed to engage the various position defining configurations on its periphery and by doing so, add to or modify the function of the door stop as herein above described.

The most significant advantage of this modification is that the tube 20 when placed in its normal position "E" extending outwardly from the mounting plate 12 can be positioned at any desired angle "α" with respect to the radial axis 98 passing through the pivot hole 28 in the pivot plate 14 as shown in FIG. 16. This adjustable multi-directional feature provides for a rigid angle adjustment of the door stop offering several installation options, among which is the adjustment of the door stop to a ninety degree angle of impact with the door striking it. To achieve this adjustment, the threaded bolt 90 is simply loosened enough to allow the tube 20 to be place at the desired angle "α" which will permit the door stop to strike the door at a ninety degree angle and then tightening the nut 94 to keep the tube 20 in plate.

Another feature of this modification is that the positions "D" and "F" can be easily inverted from one side to the other by simply inverting the top and bottom sides of the extension member 84. Thus, the cam surface "F" can be placed on the right side instead of the left side of the mounting plate 12 as originally shown in FIG. 16.

Still another feature of this modification is the ability to add additional configurations or function positions such as the notches "A", "B" and "C" located at the opposite or inner end 86 of the extension member 84. To employ these functions, it is a simple matter to reverse the extension member 84 so that its inner end 86 becomes its outer end, allowing the wheel 70 to contact one of the several notches or cam surfaces for locking the tube 20 in place or returning it to its normal position. The opposite end 88 of the extension member 84 is secured in place at the desired angle "α" by inserting the bolt 90 through the mounting hole 96 and then tightening the nut 94.

The ability of the extension member 84 to be positioned at a desired angle in conjunction with the multiple selections of configurations or positions "A" through "F", for example, combined with the ability to invert the extension during assembly, thus changing the configuration "F" from a left hand to a right hand return swing, extends the installation options by either locking the door stop in a particular angle or use position or as in the case of position "F", allowing the door stop to swing and return to its starting position.

The multi-function extension modification just described when added to the basic elements of the door stop, allows for infinite adjustment of the angle of the door stop offering alignment adjustments to assure a ninety degree door impact regardless of wall configuration or installed position of the door or door stop.

It is further possible with the multi-function extension modification to duplicate with one door stop virtually all special application door stops on the market today including, for example, the so-called "kick-down door stop" which prevents the door from closing and the so-called "door hinge or butt pin stop" which prevents the door from opening beyond a specified distance.

Additionally, the extension modification provides for additional configurations or positions other than those described above for the basic door stop. These positions allow the door stop, when door or floor mounted, to be at a right angle from the mounting surface and the selected fixed position of the extension, allowing the door stop to be swung ninety degrees from its active position, out of the way, to an inactive position.

In instances where the angle of impact of the door requires an extension for adjustment of the door stop for impact purposes, the basic door stop does not lose its swing and return or swing and hold functionality, all of which are replaced by positions provided on the extension itself, such as those at "D", "E" and "F", for example.

Figure 20:
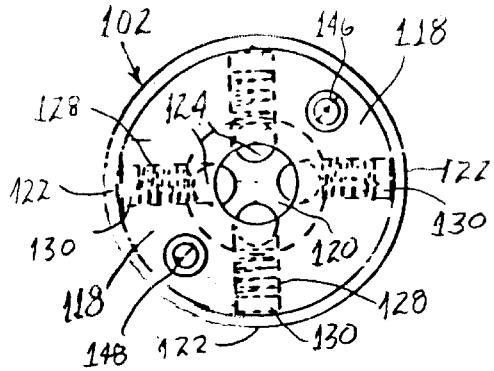
FIG. 20 is a frontal elevational view of the door restraint device shown in FIG. 19.
Figure 19:
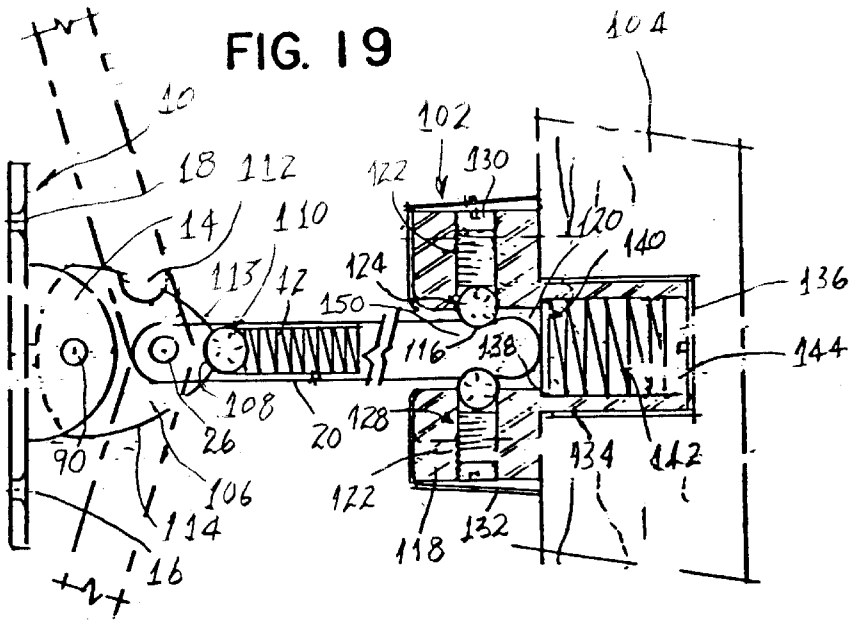
FIG. 19 is a top plan view of a multi-functional door stop similar to that shown in FIG. 16 employed in combination with a door restraint device according to the invention.

The door stop of the invention is advantageously employed in combination with a door restraint device for holding a door in an open position, for example, substantially parallel to a wall. Such a device is provided in accordance with the invention as shown in FIGS. 19 and 20. As shown, the door restraint 102 is typically mounted on the inner side of the door 104 facing the wall on which the door stop is mounted. It should be noted, however, that the door stop could also be mounted to the floor employing the extension modification just described to position the door stop perpendicular to the door 104 and at a ninety degree angle to the floor.

The door stop shown in this embodiment is basically the same as that described herein above but, in this case, employs a different or modified extension member 106. As shown, the extension member 106 is somewhat triangular in shape and has a notch 108 at its outer apex end for engaging the spring-loaded ball 110 inside the inner end of the tube 20. The extension member 106 further includes a notch 112 on one of its sides or periphery 113 for engaging and holding the tube 20 when swung to the right side of the door stop. The other periphery or side 114 of the extension member 106 is configured so as to return the tube 20 to its normal position when swung to the left side as herein before described. In the embodiment of the doorstop shown in FIG. 19, the tube 20 is further equipped at its outer end with a neck 116 for engaging the door restraint device at shall be made more clear hereinafter. As described before, the extension member 106 is adjustable affixed to the mounting bracket 12 by a means of the bolt 90 at a ninety degree angle with respect to the bracket 10, that is, in this case, without employing the off-set or variable adjustment feature of the invention.

Figure 22:
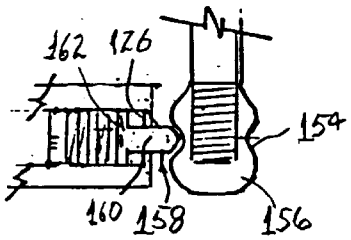
FIG. 22 is a similar view showing another modification of the door restraint device.

The door restraint device of the invention as shown in FIGS. 19 and 20 comprises a solid body portion made of metal or a molded plastic material which, in this case, takes the form of an annular ring 118. The ring 118 has at its center a longitudinal bore 120 which is slightly larger in diameter than the outer end of the door stop tube 20. Spaced equidistantly apart within the ring 118 are four transverse bores each indicated at 122. Although four transverse bores 122 are shown in the drawing, it will be understood that a lesser or greater number of bores, say at least two and preferably three bores, can be used. The bores 122 extend from the outer side wall or periphery of the ring 118 and intersect the center bore 120 ninety degrees apart. A metal ball 124 is mounted inside each one of the four transverse bores 122, each one of the balls 124 being restrained from passing into the center bore 120 by suitable means, such as by a reduced diameter lip 126 surrounding the opening of each bore as shown in the modification of FIG. 22. The particular size of the lip 126 is chosen such that a portion of each ball 124 (less than half) is allowed to extend slightly into the center bore 120. A coil spring 128 is placed in each transverse bore 122 in contact with the metal ball 124 and maintains the ball in contact under pressure with the lip 126. A plug 130 is threaded into the outer end of each transverse bore 124 in contact with the opposite end of each coil spring 128. The plug 130 serves as a means to adjust the pressure applied to each one of the balls 124. To enhance the appearance of the door restraint when mounted to the door, a metal jacket 132 may be mounted or snapped into place around the ring 118.

As best shown in FIG. 19, the annular ring 118 is further formed integrally with a co-axial tubular sleeve 134 which is set inside a circular cut-out 136 on the back side of the door. The sleeve 134 is made slightly larger in diameter than the center bore 120, forming an annular lip 138 surrounding the opening of the sleeve into the center bore 120. A spring plate 140 rests against the lip 138 and is urged into contact with the lip by a heavier coil spring 142 mounted inside the sleeve 134. The coil spring 142 may provide a fixed pressure on the spring plate 140 as desired or a plug 144 threaded into the outer end of the sleeve 134, as shown in the drawing, may serve as a means for adjusting the pressure applied to the plate 140. As shown in FIG. 20, the ring 118 is secured in place against the back of the door by a pair of mounting screws 146, 148.

Once the door restraint device is assembled onto the door and the door stop aligned with the door as described herein above, the door can be easily held in place and kept open, for example, by swinging the door back in a direction toward the wall until the bumper 150 on the door stop enters the center bore 120 and engages the spring-loaded balls 124. The balls 124 are urged outwardly by coil springs 128 and grasp the neck 116 on the bumper 150, holding the door firmly in place against the wall. To release the door from the hold, the door may be tapped backwards against the spring plate 140, in which case, the heavier coil spring 142, acting as a "cushion", will be compressed, and upon release, will cause the door to be freed from its hold position. This feature can be kept to a desired release pressure by adjusting the threaded plug 144. The cushion effect provided by the spring plate 140 also offers the added advantage in that it is able to absorb the shock created when the door is slammed against the door stop and, in this case, helps prevent possible damage to the door.

Figure 21:
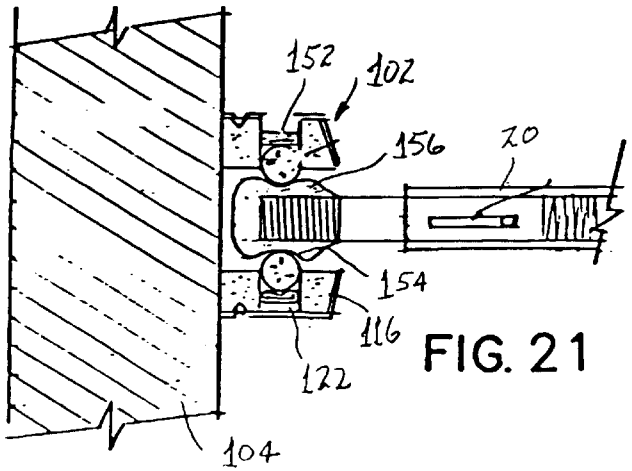
FIG. 21 is a side elevational view, partly in section, showing a modification of the door restraint device shown in FIG. 19.

A number of modifications of the door restraint device are possible in accordance with the invention. For example, as shown in FIG. 21, a rubber band 152 can be used to replace the four coil springs 128 that are used to bias the balls 124 into engagement with the neck 154 formed on a specially designed bumper 156. A conventional O-ring can also be used for the same purpose. The rubber band or O-ring enhances ease of assembly and significantly reduces manufacturing cost. The bumper 156 is designed to be easily threaded over the end of the tube 20 to aid in replacement when the bumper becomes worn after continued use.

FIG. 22 shows a further modification wherein a spring-loaded point 158 is used to replace the four metal balls 124 in the door restraint device described above. The point 158 has a stem 160 which engages the neck 154 on the bumper 156 and a back plate 162 which limits the travel of the stem by contacting the lip 126.

Figure 23:
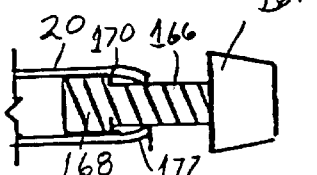
FIGS. 23 and 24 are similar views showing additional modifications of a door stop according to the invention.
Figure 24:
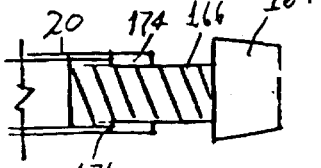

A further modification of the bumper assembly is shown in FIGS. 23 and 24. As shown, the bumper 164 is attached to a stem 166 which as before is spring-loaded by a coil spring (not shown) and which extends through the outer open end of the tube 20. The stem 166 is provided with an enlarged stub 168 at its reward end forming an annular ridge 170. In FIG. 23, the annular ridge 170 limits the outward movement of the stem 166 by contacting the swaged end of the tube 20 as shown at 172. Basically, the same principle applies to the bumper modification that is shown in FIG. 24. Here, the outer end portion of the tube 20 is reduced in diameter to provide a similar annular ridge 176 which stops or limits the outward movement of the stem 168 and bumper 164.

What is claimed is:

1. A multi-function door stop comprising:

a first vertical member;

a second horizontal member extending outwardly from said first member;

a third elongated member extending outwardly from said second member in a normal position substantially perpendicular to said first member;

a fourth member interposed between said second member and said third member, said fourth member being fixedly secured to said second member and pivotally connected to said third member whereby said third member is able to swing in a direction away from said normal position; and means associated with said fourth member for releaseably locking said third member in said normal position.

2. A multi-function door stop according to claim 1 wherein said first and second members are joined together in the form of an L-shaped bracket and wherein said fourth member is an adjustable extension having a first end which is fixedly secured to said bracket and a second end having an arcuately shaped periphery.

3. A multi-function door stop according to claim 2 wherein said third member comprises an elongated hollow tube having an inner and an outer end, said inner end of said tube having a pair of opposed rectangular slots forming a yoke which fits over said second end of said adjustable extension allowing said tube to pivot freely over said arcuately shaped periphery thereof.

4. A multi-function door stop according to claim 3 further including a cam follower and a spring mounted within said inner end of said tube, said spring biasing said cam follower into contact with said arcuately shaped periphery of said extension.

5. A multi-function door stop according to claim 4 wherein said locking means includes a notch formed within said arcuately shaped periphery of said adjustable extension, said notch releaseably engaging said cam follower.

6. A multi-function door stop according to claim 5 wherein said cam follower comprises a roller ball.

7. A multi-function door stop according to claim 5 wherein said cam follower comprises a wheel.

8. A multi-function door stop according to claim 5 wherein said cam follower comprises a pointed member.

9. A multi-function door stop according to claim 5 wherein a cam surface is disposed on said arcuately shaped periphery of said adjustable extension, said cam surface having a configuration such that when said tube is swung away from its normal position, said cam follower is forced inwardly against said spring, increasing the bias pressure and forcing said tube to return to its normal position.

10. A multi-function door stop according to claim 2 wherein said second end of said adjustable extension has a second arcuately shaped periphery provided with at least one of a notch and cam surface, said extension being reversibly mounted to both said second and third members so as to allow said cam follower to contact said second arcuately shaped periphery provided with said one of said notch and cam surface.

11. A door restraint device capable of accepting and holding the outer end of a door stop having a neck comprising:

a body having a longitudinal bore and a plurality of transverse bores intersecting said longitudinal bore;

a retainer member disposed within each one of said transverse bores;

first spring means associated with said retainer member biasing said retainer member in a direction toward said longitudinal bore;

means associated with said transverse bores limiting movement of said retainer members into said longitudinal bore, said limiting means allowing said retainer members to contact said neck and restrain said door stop upon entering said longitudinal bore;

a tubular bore extending co-axially behind said longitudinal bore;

a cushion member positioned between said longitudinal bore and said tubular bore; and second spring means disposed inside said tubular bore biasing said cushion member in a direction toward said longitudinal bore, said second spring means enabling release of said door stop when pushed forward to contact said cushion member.

* * * * *